US007427010B2

(12) United States Patent
Sutherland

(10) Patent No.: US 7,427,010 B2
(45) Date of Patent: Sep. 23, 2008

(54) CARTON LOCK

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 618 days.

(21) Appl. No.: 10/703,704

(22) Filed: Nov. 7, 2003

(65) Prior Publication Data

US 2004/0099542 A1 May 27, 2004

Related U.S. Application Data

(63) Continuation-in-part of application No. 10/183,935, filed on Jun. 27, 2002, now abandoned.

(51) Int. Cl.
*B65D 5/42* (2006.01)
*B65D 17/00* (2006.01)

(52) U.S. Cl. ..... 229/198.2; 229/103.2; 229/242; 229/243; 206/140; 206/141; 206/429; 206/431

(58) Field of Classification Search ..... 229/198.2, 229/103.2, 242–243; 206/140, 141, 439, 206/427–435

See application file for complete search history.

(56) References Cited

U.S. PATENT DOCUMENTS 3,128,010 A * 4/1964 Forrer ..... 206/155
3,375,968 A * 4/1968 Weiss ..... 206/139
4,032,053 A * 6/1977 Wilson ..... 206/428
4,382,505 A * 5/1983 Sutherland et al. ..... 206/180
4,574,997 A 3/1986 Ikeda
4,708,284 A * 11/1987 Sutherland et al. ..... 229/198.2
5,060,804 A * 10/1991 Beales et al. ..... 229/240
5,197,598 A * 3/1993 Stout et al. ..... 206/141
5,246,112 A * 9/1993 Stout et al. ..... 206/427
5,246,122 A * 9/1993 Schick et al. ..... 215/382
5,328,080 A 7/1994 Holley, Jr.

(Continued)

FOREIGN PATENT DOCUMENTS

EP 0 159 172 A2 10/1985

(Continued)

OTHER PUBLICATIONS

Notification of Reason for Refusal - JP 2006-538059.

*Primary Examiner*—Tri M Mai
(74) *Attorney, Agent, or Firm*—Womble Carlyle Sandridge & Rice, PLLC

(57) ABSTRACT

This invention relates to a wrap-around carrier which is held together by a single locking system, which is a secondary locking system in which the secondary male locks are formed as an extension of an outer secondary locking flap with an inner bottom flap having a secondary female opening for each secondary male lock. Assistance in holding the secondary male locks in the vertical locked position between two containers in the carrier is provided by a female flap formed in the female opening in the inner bottom flap. Further assistance is provided in holding the secondary male locks in the vertical lock position between two containers by the containers having flexible side walls and carrying a liquid whose weight pushes out against the walls of the container and creates tension in the wrap-around carrier thereby holding the secondary male locks in the vertical locked position.

17 Claims, 5 Drawing Sheets

U.S. PATENT DOCUMENTS

| | | | |
|---|---|---|---|
| 5,437,363 | A | 8/1995 | Gungner |
| 5,472,138 | A | 12/1995 | Ingram |
| 5,524,756 | A | 6/1996 | Sutherland |
| 5,975,286 | A | 11/1999 | Oliff |
| 6,021,899 | A | 2/2000 | Sutherland |
| 6,315,123 | B1 | 11/2001 | Ikeda |
| 6,378,697 | B1 | 4/2002 | Sutherland et al. |
| 6,378,765 | B1 | 4/2002 | Sutherland |

FOREIGN PATENT DOCUMENTS

| | | |
|---|---|---|
| EP | 0 242 992 A2 | 10/1987 |
| GB | 1172430 | 11/1969 |
| JP | 61-2545 | 1/1986 |
| JP | 62-231736 | 10/1987 |

* cited by examiner

CARTON LOCK

CROSS-REFERENCE TO RELATED APPLICATION

This is a continuation-in-part application of U.S. patent application Ser. No. 10/183,935, entitled Improved Carton Lock, of which Robert L. Sutherland is the inventor, which was filed on Jun. 27, 2002, now abandoned which is hereby incorporated by reference.

BACKGROUND OF THE INVENTION

1. Field of the Invention

This invention relates to a wrap-around carrier which is held together by a secondary locking system with overlapping flaps without the necessity of using any primary locking system.

2. Background

When fabricating a carrier from a paperboard blank, opposite ends of the blank are conventionally attached to each other by glue or by mechanical locks to form the bottom panel of the carrier. In the case of a wrap-around carrier, flaps located on the ends of the blank typically are overlapped and engaged with one another by mechanical locks formed in the flaps to form the bottom panel of the carrier. Since the bottom panel must maintain its integrity throughout the use of the carrier, it is essential that the locking system be capable of supporting the weight of the packaged articles, and remain engaged during shipping and handling of the constructed carrier.

The conventional way of providing a stable mechanical lock for a wrap-around carrier utilizes both primary and secondary locks. The secondary locks are basically a "back-up" to primary locks.

When containers with flat bottoms are placed in a wrap-around carrier in two rows, it is difficult to lock a primary lock system as the male locks will be prevented from locking by the bottoms of the containers It would also be desirable to provide a wrap-around carrier which only has a single locking system as it would result in a significantly saving of the material, such as paperboard, used to construct the carrier.

SUMMARY OF THE INVENTION

This invention provides a wrap-around container carrier which is locked together by a single locking system. This carrier has a top panel, opposite side panels and a bottom panel which is formed from an inner bottom flap and an outer bottom panel which is foldably attached to an outer secondary locking flap. The outer secondary locking flap overlaps a portion of the inner bottom flap with the flaps being held together by at least one secondary male lock formed as an extension of the outer secondary locking flap. The inner bottom flap has a secondary female opening for each secondary male lock. This secondary female opening is formed by a slit and an innerconnecting fold line which forms a female flap in the female opening. This female flap leans against the secondary male lock when it has been extended through the female opening to assist in holding the secondary male lock in the vertical locked position in respect to the inner bottom flap so the lock does not become accidentally disengaged. Each secondary male lock and corresponding female opening in the carrier are located between the two rows of containers.

This container carrier is especially usefully for carrying light weight containers with flexible side walls which contain a liquid or a semi-liquid. The liquid in the containers tends to result in an outward bulging of the side walls of the container caused by the weight of the liquid in the container. When these containers are placed in two rows and the wrap-around carrier wrapped around the containers is tightly locked, the slight bulging of the side walls of the containers adjacent the side panels of the carrier results in a corresponding bulging in the side panels of the carrier which pulls and holds each secondary male lock in the vertical locked position. The bulging of the side panels of the carrier creates tension in the carrier which pulls and holds each secondary male lock in the vertical locked position in respect to the inner bottom flap so the lock does not become accidentally disengaged. The inside walls of the containers are pushed to a vertical position by the tightening of the carrier which aids in holding the secondary male locks in the vertical position.

The female flap formed from the secondary female opening may have an arcuate tab to assist in holding the secondary male lock in the vertical position.

The carrier of this invention is especially useful for carrying containers with flexible side walls which contain a liquid or semi-liquid. Examples of such containers with flexible side walls are the square PET bottles, Tetrapak® containers and yogurt containers with flexible side walls. The secondary locking system of this invention is especially usefully with light containers e.g. six to ten ounces.

The carrier of this invention preferably has means for preventing the containers from falling out of the ends of the carrier, which preferably consists of the top panel having two ends with a top end panel attached to each end of the top panel of the carrier with the top end panels being capable of being folded into a closed position on a wrap machine when the top end panel is closed by pressure from a three piece web connected by fold lines, said web interconnected by fold lines to each side panel and adjacent top end panel and consisting of a triangular shaped gusset panel connected by a fold line to a top end panel and in turn connected by a fold line to a triangular shaped web panel which in turn is connected to a tuck-in panel connected by a fold line to an adjacent side panel, said tuck-in panel having a holding tab attached away from the connection to the side panel to hold the top end panel in the closed position.

The carrier of this invention may have one or two top dispenser flaps in the top panel which extend into the adjoining side panels which may be torn open for the easy removal of the containers in the carrier. A carrying handle may be provided in the top panel adjacent to the top dispenser flap for carrying the carrier.

These and other objects, features, and advantages of the present invention will become more apparent upon reading the following specification in conjunction with the accompanying drawing figures.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

The present invention is intended primarily for use in wrap-around carriers for containing containers filled with a liquid or semi-liquid having flexible side walls. In the present invention, a single locking system is used in a wrap-around carrier without any "back-up" locking system. The locking system used in this invention is a secondary locking system without using any primary locking system. This secondary locking system is especially useful with containers which have flexible side walls. When these containers with flexible side walls contain a liquid or semi-liquid, the weight of the liquid pushes against the side walls of the containers which in turn push against the side panels of the carrier creating tension on the male lock which holds it in the vertical locked position. The term liquid is used to include both conventional liquids and semi-liquids.

Figure 1:
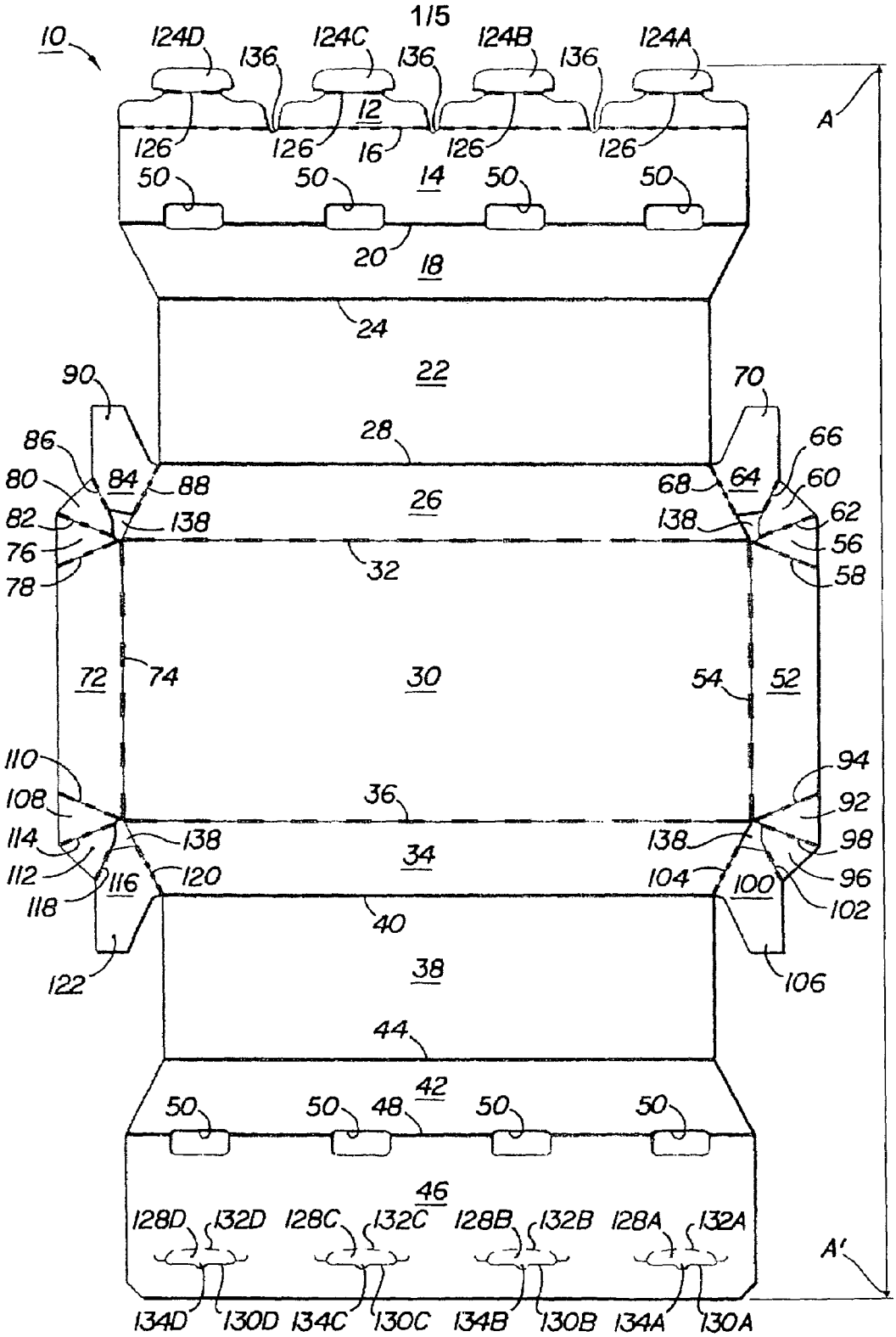
FIG. 1 is a plan view of a blank which incorporates the locking features of the present invention.

The blank for forming the carrier of this invention is illustrated in FIG. 1. This blank 10 is designed to contain eight beverage containers arranged in two rows of four each. The blank 10 is formed from a foldable sheet of material, such as paperboard. The blank has an outer secondary locking flap 12, which is foldably connected to outer bottom panel 14 by fold line 16, and in turn connected to lower side panel 18 by fold line 20. Lower side panel 18 is connected to middle side panel 22 by fold line 24, which in turn is connected to upper side panel 26 by fold line 28, and in turn connected to top panel 30 by fold line 32. In a similar fashion, top panel 30 is connected to upper side panel 34 by fold line 36, which in turn is connected to middle side panel 38 by fold line 40 and in turn connected to lower side panel 42 by fold line 44. Lower side panel 42 is connected to inner bottom flap 46 by fold line 48. Lower side panel 18, middle side panel 22 and upper side panel 26 essentially constitute one side panel 152, (FIGS. 5-7) while lower side panel 42, middle side panel 38 and upper side panel 34 essentially constitute the opposite side panel 154 of the carrier.

This carrier 10 has apertures 50 for containing the heels of containers contained therein. The tops of the containers are restrained from falling out of the ends by the top end panels. Top end panel 52 is connected to top panel 30 by fold line 54. Top end panel 52 is connected to triangular gusset panel 56 by fold line 58 which in turn is connected to triangular web panel 60 by fold line 62. Triangular web panel 60 is connected to tuck-in panel 64 by fold line 66, which in turn is connected to upper side panel 26 by fold line 68. Tuck-in panel 64 has a holding flap 70 for holding top end panel 52 in proper position in contact with the end containers in the carrier.

In a similar fashion, top end panel 72 is connected to top panel 30 by fold line 74. Tuck-in panel 72 is connected to triangular gusset panel 76 by fold line 78 and in turn connected to triangular web panel 80 by fold line 82 and finally connected to tuck-in panel 84 by fold line 86. Tuck-in panel 84 is connected by fold line 88 to upper side panel 26. Tuck-in panel 84 has a holding flap 90.

Top end panel 52 is connected to triangular gusset panel 92 by fold line 94 and in turn connected to triangular web panel 96 by fold line 98. Triangular web panel 96 is connected to tuck-in panel 100 by fold line 102. Tuck-in panel is connected to upper side panel 34 by fold line 104 and has a holding flap 106. End panel 72 is connected to triangular gusset panel 108 by fold line 110 and in turn connected to triangular web panel 112 by fold line 114. Triangular web panel 112 is connected to tuck-in panel 116 by fold line 118, which in turn is connected to upper side panel 34 by fold line 120. Tuck-in panel 116 has a holding flap 122.

Figure 3:
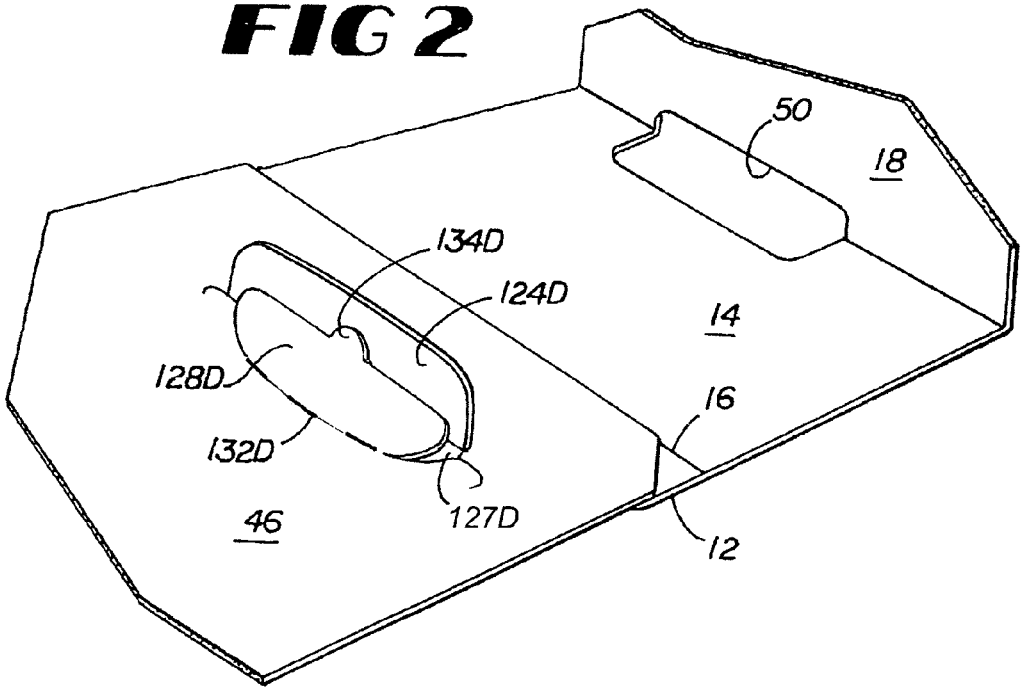
FIG. 3 is a perspective view of the bottom of the carrier with the locks held in the proper locked position.

As previously mentioned, the carrier of this invention is unique in that it has only a secondary locking system, and no primary locking system. Secondary male locks 124A-D are connected to outer secondary locking flap 12 by fold line 126. The secondary female locking system is located in inner bottom flap 46 and has secondary female flaps 128A-D formed by cut lines 130A-D. The secondary female flaps 128A-D have fold lines 132A-D for folding the flaps into the locked position. These secondary female flaps 128A-D assist in holding the secondary male locks 124A-D in the vertical locked position. Arcuate tabs 134A-D may be provided to assist in holding the secondary male locks 124A-D in the vertical locked position. The secondary male locks 124A-D extend through the secondary female openings as best shown in FIG. 3 as number 127D.

It will be understood by those in the art that the preferable carrier is symmetrical about a horizontal line of bisection, as viewed from FIG. 1. This symmetry aids in the efficient production of the present carrier. The carrier need not have such symmetry, although it is preferred. As shown, the blank 10 is rectangular in shape and includes straight edges, which also makes for an efficient layout of the blank in a web from which the blanks are cut.

Unlike conventional locking systems, the carrier of this invention does not include both a primary locking system and a secondary locking system. Rather, it has been found that a secondary locking system alone will satisfactorily hold the carrier together, especially when carrying containers with flexible side walls which are filled with a liquid.

Figure 2:
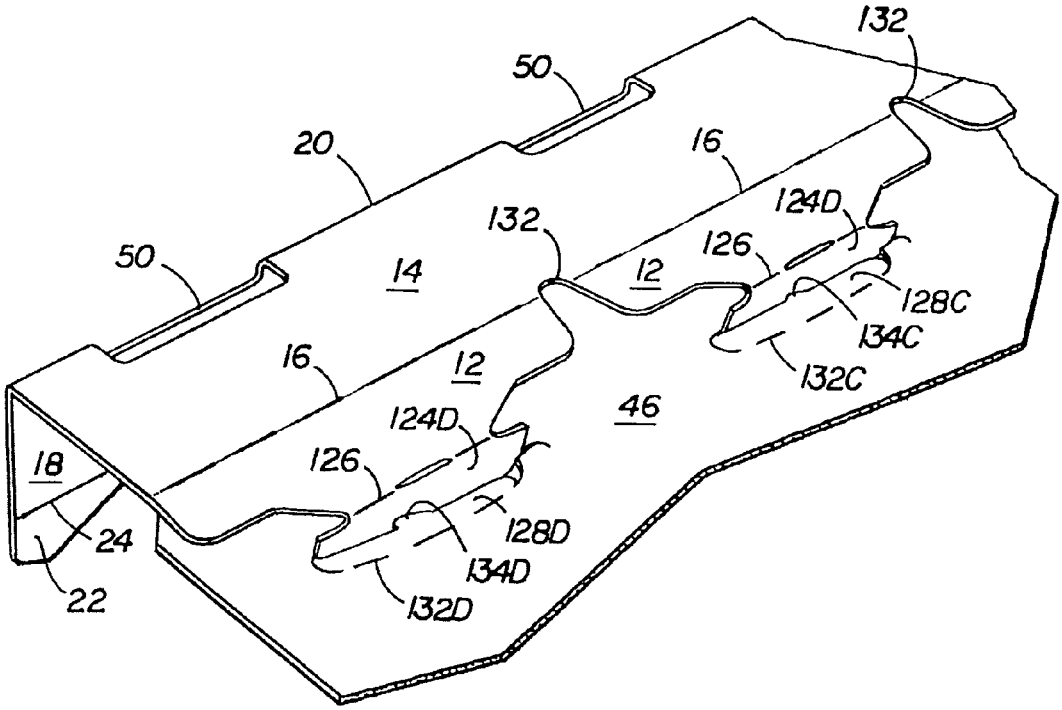
FIG. 2 is a perspective view of the bottom of the carrier with the secondary locks about to be engaged with the female openings.

It will be noticed from FIG. 1 that each pair of secondary locking locks is aligned longitudinally, i.e. the length of the blank (A-A'). The secondary male locks 124A-D are aligned longitudinally, respectively, with cut lines 130A-D of the secondary female locks. When the carrier is formed from the blank this longitudinal line runs through the containers C and the corresponding secondary male lock 124D and corresponding secondary female opening. (e.g. 127D in FIG. 2

This invention provides a single locking system, which is a secondary locking system, which securely locks the wrap-around carrier filled with containers. It is important that the secondary male locks 124A-D are held in the vertical locked position in respect to the inner bottom flap 46. The secondary female flaps 128A-D assist in holding the secondary male locks 124A-D, respectively, in their vertical locked position. The arcuate tabs 134A-D further assist in holding the secondary male locks 124A-D in their vertical locked position.

Figure 5:
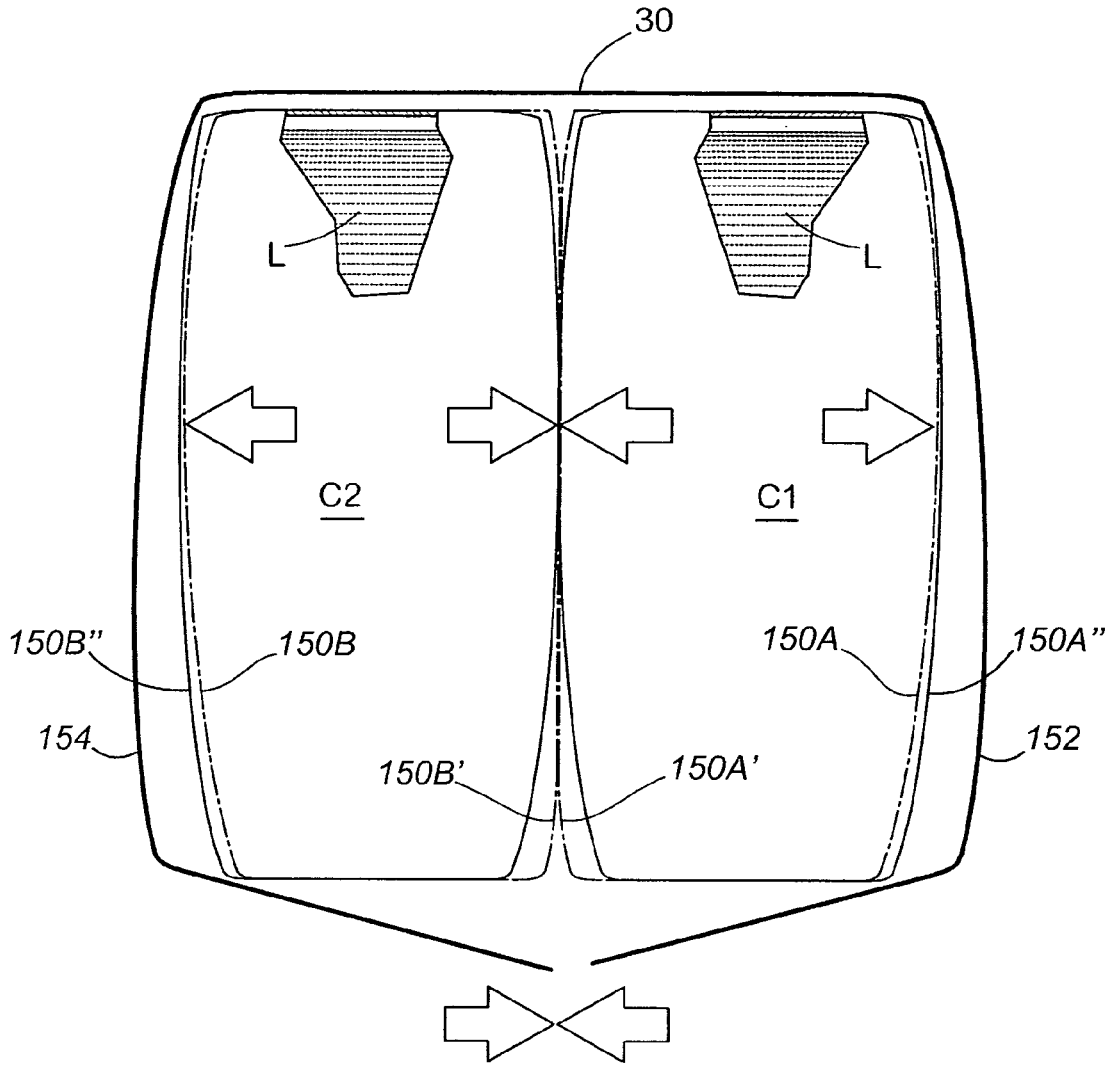
FIG. 5 is a symmetrical end elevation of the blank of FIG. 1 in the process of wrapping the blank around two rows of containers filled with a liquid with the containers being held tightly against each other which shows outward forces on the side walls of the containers exerted by the weight of the liquid inside the containers.

The wrap-around carrier of this invention is formed from the blank of FIG. 1 by moving the top panel 30 of the blank over the containers C1 and C2 which are aligned in two rows as shown in FIG. 5. These containers C1 and C2 have flexible side walls 150A" and 150B" respectively. These containers C1 and C2 contain a liquid where the weight of the liquid presses against the side walls 150A" and 150B" as illustrated in FIG. 5. When the containers C1 and C2 are aligned in two rows and held tightly against each other, pressure is exerted by the liquid in the containers against the inner side walls which offset each other, resulting in holding them in a straight vertical position as illustrated by phantom lines 150A' and 150B' (inner side walls). This results in a container C1 in one row being pulled toward a container C2 in the other row which tends to hold the secondary male locks between the rows in the vertical position as illustrated by secondary male lock 124A in FIGS. 6 and 7.

The blank 10 is pulled tight about the containers C1 and C2 and the outer secondary locking flap 12 is lapped over the inner bottom flap 46 with the outer secondary locking flap 12 being on the outside of the carrier. Slits 136 facilitate locking the locks one at a time. The secondary male locks 124A-D are bent along fold line 126 and are punched in where they enter into primary female openings (e.g. 127D in FIG. 3) by cut lines 130A-D. The secondary female flaps 128A-D assist in holding the secondary male locks 124A-D in the vertical locked position in respect to inner bottom flap 46. The arcuate tabs 134A-D on each secondary female flap 128A-D lean against the secondary male locks 124A-D and also assist in holding the secondary male locks in the vertical locked position.

Figure 6:
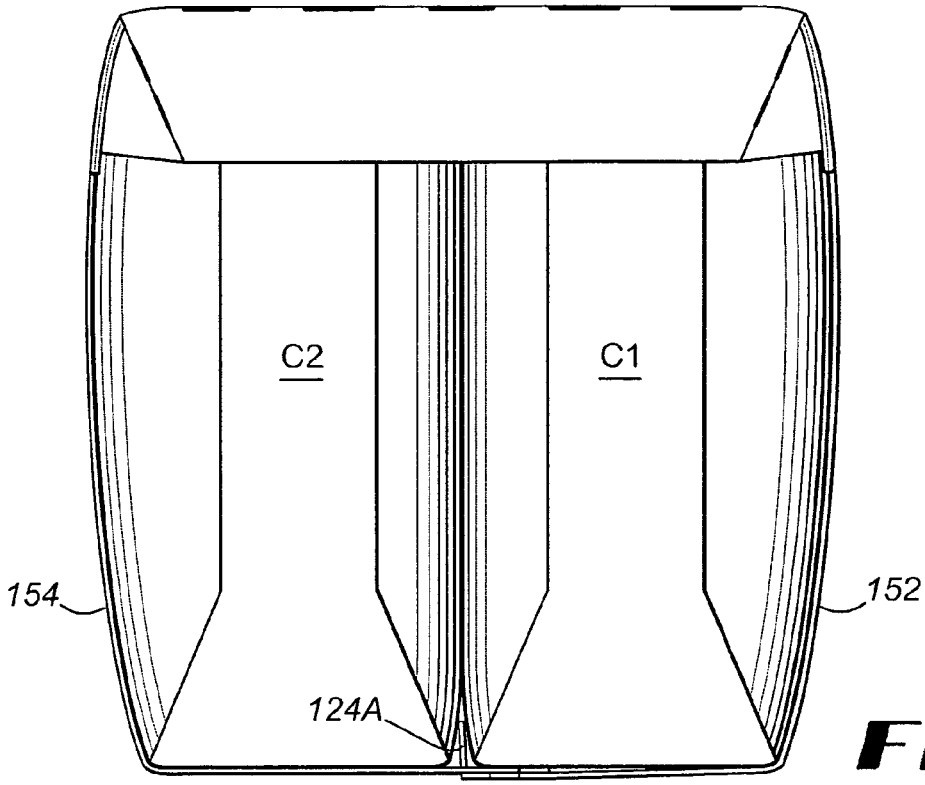
FIG. 6 is an end elevation of the carrier of FIG. 4 loaded with containers.
Figure 7:
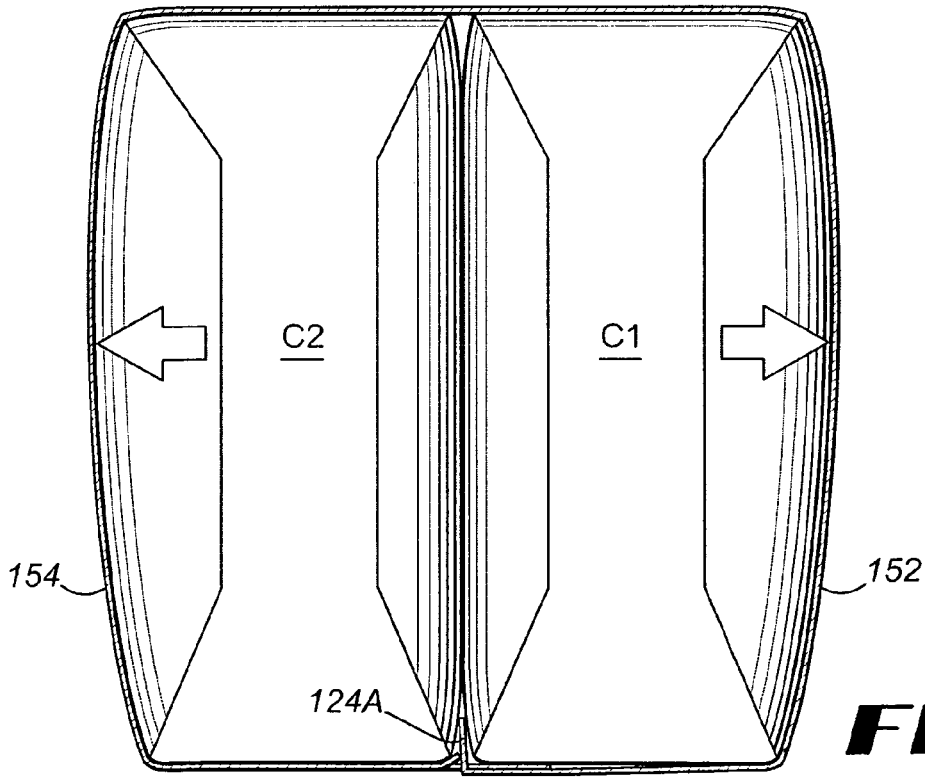
FIG. 7 is a cross-sectional view of the carrier of FIG. 4 taken along a line through a secondary male lock and the corresponding secondary female lock and the containers in two rows.

As the blank 10 is pulled around the containers C1 and C2 and locked, the weight of the liquid L in the containers pushes outwardly against side walls 150A" and 150B" of containers C1 and C2 respectively as shown in FIG. 5. This results in pushing the inner side walls of containers C1 and C2 into the straight vertical position as illustrated by phantom lines 150A' and 150B' (inner side walls) which tends to hold the secondary male locks 124A-D in the vertical position. This shifts containers C1 and C2 towards each other, but also results in the outward budging of the outer side wall of container C1 and C2 to a position located by phantom lines 150A and 150B (outer side walls). The slight budging out of outer side walls 150A and 150B creates tension on the carrier which results in assisting and pulling the secondary male locks 124A-D into the vertical locked position as illustrated in FIGS. 6 and 7. Holding the secondary male locks 124A-D in the vertical position ensures that the locks are not accidentally withdrawn. Thus, the secondary male locks 124A-D are held in the vertical locked position by a combination of the secondary female flaps 128A-D and the pressure exerted on the side panels 152 and 154 of the carrier and directly on the secondary male locks by the liquid in the containers C1 and C2. If the secondary male locks were bent into a horizontal position in relation to the bottom flap 46 they could easily become disengaged.

Top end panels 52 and 72 are pushed inwardly into the end containers by pushing tuck-in panels 64, 84, 100 and 116 and the respective triangular shaped web panels 60, 80, 96, and 112 and the triangular gusset panel 56, 76, 92 and 108. Holding flaps 70, 90, 106 and 122 hold the top end panels 52 and 72 in proper position with the holding flaps being between the container and the sides of the carrier.

The locking system of this invention consists of a single secondary locking system which works in combination with the pressure exerted directly on the secondary male locks by the liquid in the containers and on the carrier by the liquid in the containers which provides the tension on the carrier to hold the secondary male locks 124A-D in the vertical locked position. The secondary female flaps 128A-D assist in holding the secondary male locks 124A-D in the vertical lock position. Additional assistance in holding the secondary male locks 124A-D in the vertical locked position may be provided by placing arcuate tabs 134A-D on each secondary female flap 128A-D which lean against the secondary male locks 124A-D.

The secondary locking system in combination with the force provided by the liquid in containers with flexible side walls eliminates the need for having a primary locking system. It is especially useful in wrapping containers that have flat bottoms where there is no room to have a primary locking system as its locking would be impeded by the flat bottoms of the containers. This invention also permits a reduction in the amount of material, such as paperboard, used to construct the carton. The longitudinal dimension A-A' of the blank can be reduced by two to three percent by eliminating the primary locking system, but still provide a locking system that is secure.

The locking system of this invention works best with containers with flexible side walls that have a cross-section that is square or rectangular. However, the secondary locking system of this invention also works with containers that have a round cross section and have flexible side walls.

This carrier is designed to be erected on a static feedlock system where there are no moving parts with compression fingers pulling the carrier together by the heel apertures. The carrier is pulled together somewhat beyond what is required for locking and then the locking becomes secure as the compression is relaxed allowing the pressure from the liquid in the containers being carried to secure the locks. This carrier is locked by a spring lifting inner bottom flap 46 upwardly with the secondary male locks 124A-D being pushed in by a stationary mechanism. The secondary locking panel 12 is wrapped around a rod in the packaging machine while another rod inserts the secondary male locks 124A-D into the secondary female opening (e.g. 127D) with the secondary male lock (124D) being held in the vertical position as shown in FIG. 3.

Because of the resiliency of the containers, compression on the heel apertures can overcompensate in locking the locking mechanism which is then slightly loosened after the lock has been set. This can be arranged between the locks so that they can be locked one at a time without putting undue stress on the adjoining lock.

Figure 4:
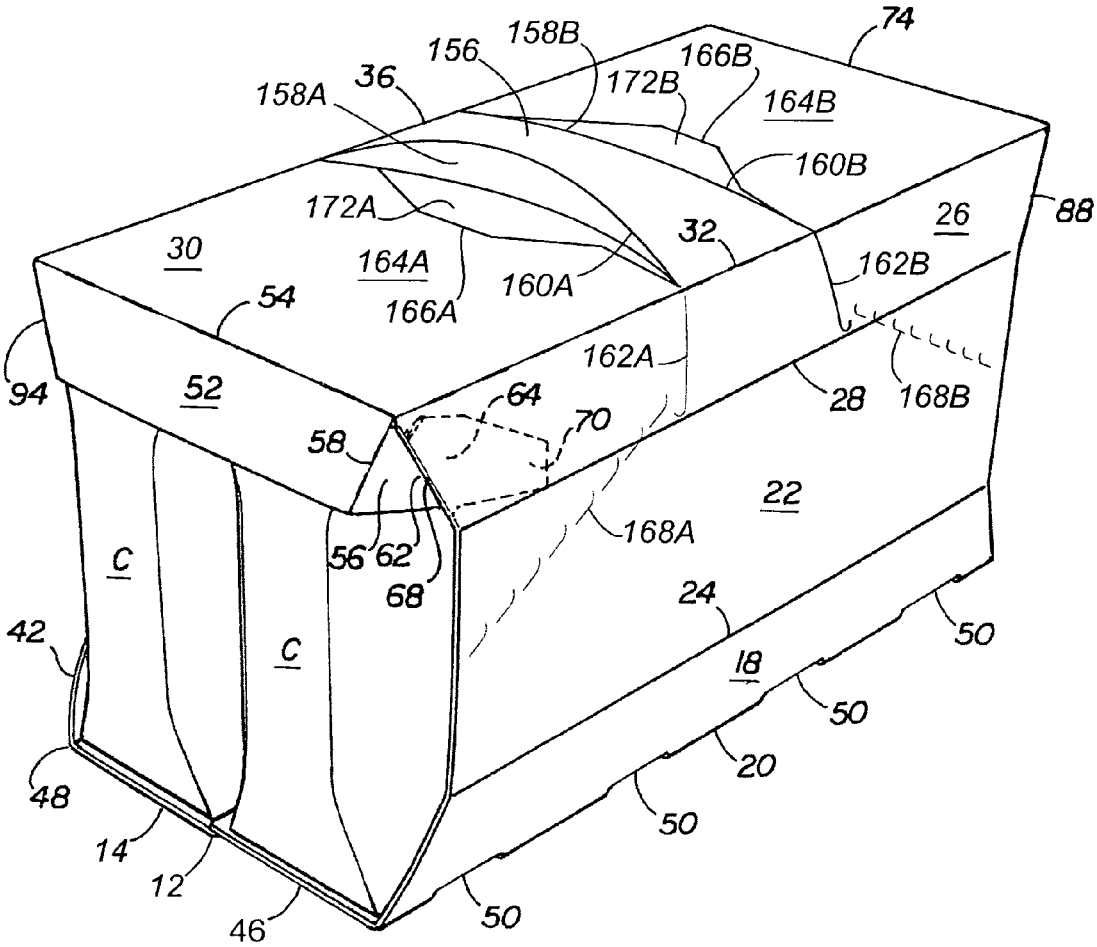
FIG. 4 is a perspective view of the carrier formed from a blank identical to the blank of FIG. 1 except for a carrying handle and two top dispenser flaps. It is loaded with containers with flexible side walls.

The carrier of this invention may have a handle and one or more dispensers. FIG. 4 shows the inclusion of a handle and two dispensers. The carrier of FIG. 4 is formed from a blank identical to the blank of FIG. 1 except for the inclusion of a handle and two dispensers. The carrier of FIG. 4 has a handle 156 that extends across the top panel 30 from upper side panel 26 to the upper top side panel 34. This handle 156 may have handle supporting flaps 158A and B to strengthen the handle to cushion a person's hand when carrying the carrier. These handle supporting flaps 158A and B are foldably attached to the handle 156 by fold lines 160A and B along which these flaps are folded to put handle 156 in proper position for carrying. Stress placed upon the handle 156 in carrying may be dissipated through stress relieving lines 162A and B into upper side panel 26. Identical stress relieving lines may be provided in upper side panel 34 (not shown in FIG. 4). When the carrier has been loaded with containers C, the handle 156 and handle supporting flaps 158A and B are part of the top panel 30 when carrier has been loaded with containers.

The carrier of this invention may have one or more top dispenser flaps 164A and B as shown in FIG. 4. The top dispenser flaps 164A and B are attached to and a part of the top panel 30 when the carrier has been filled with containers C. Apertures 172A-B are shown between top dispenser flaps 164A and 164B and the handle 156, respectively. If desired these apertures 172A and B can be filled with flaps attached to the top panel 30 and connected to handle 156 via a flap attached to cut line 166A or 166B.

Top dispenser flap 164A has a tear line 168A that extends through middle side panel 22 into upper side panel 26. A similar tear line is located on the opposite side of the carrier (not shown). The carrier illustrated in FIG. 4 also has a second top dispenser flap 164B with a corresponding tear line 168B that extends through middle side panel 22 into upper side panel 26. A similar tear line is provided on the other side of the carrier for top dispenser flap 164B (not shown).

Using top dispenser flap 164A as an example, this flap can be torn opened by inserting the hand into aperture 172A and pulling upward along cut line 166A and towards top end panel 52. This will result in tearing along stress relieving line 162A and the corresponding stress relieving line on the other side of the carton which will extend into tear line 168A and the corresponding tear line on the other side of the carton. If the tearing along tear line 168A and corresponding tear line on the other side of the carton is completed, then top dispenser flap 164A is totally removed from the carrier. The tearing can be stopped prior to the removal of top dispenser flap 164A as long as containers C can be removed from the carrier. Top dispenser flap 164B can be opened and removed in the same fashion by pulling along cut line 166B. This carrier can be provided with one or two top dispenser flaps. It should also be realized that the handle 156 can be placed in the carrier without having any top dispenser flap. Similarly one or more top dispenser flaps can be located in the carrier without the inclusion of a handle.

While the invention has been disclosed in its preferred forms, it will be apparent to those skilled in the art that many modifications, additions, and deletions can be made therein without departing from the spirit and scope of the invention and its equivalents as set forth in the following claims.

What is claimed:

1. A wrap-around container carrier loaded with a plurality of containers filled with a liquid comprising:

(a) a carrier with a top panel, opposite side panels and a bottom panel, with the bottom panel formed from an inner bottom flap and an outer bottom panel foldably attached to an outer secondary locking flap, said outer secondary locking flap overlapping a portion of the inner bottom flap, said flaps being held together by a single locking system, in which at least one secondary male lock is formed as an extension of the outer secondary locking flap, the inner bottom flap having a secondary female opening for each secondary male lock, said opening formed by a slit and interconnecting fold line which forms a female flap in the female opening, said female flap leaning against the secondary male lock which extends through the female opening to assist in holding the secondary male lock in the vertical locked position in respect to the inner bottom flap so the lock does not become accidentally disengaged; the top panel including top end restraining panels comprising top end flaps, tuck-in panels, triangular shaped web panels, triangular gusset panels, and holding flaps; the top end restraining panels restraining the containers in the carrier;

(b) the plurality of liquid containers having a rectangular or square cross-section and including a top, a bottom, and flexible side walls connecting the top and bottom and being aligned in two rows in the carrier with one wall of each container being adjacent a side panel of the carrier;

(c) with each secondary male lock and corresponding secondary female opening in the carrier being located between said liquid containers in each row; and (d) the secondary male locks in the corresponding secondary female openings having further assistance in being held in the locked vertical position by the slight bulging outwardly of the side walls of the containers which are adjacent the side panels of the carrier, said bulging caused by the weight of the liquid in the containers which in turn results in corresponding bulges in the side panels of the carrier which creates tension in the carrier that pulls and holds each secondary male lock in the vertical locked position between the containers in each row, the weight of liquid in the containers resulting in inner side walls of each said container being held tightly against each other in straight vertical positions, pulling the containers in each row towards each other.

2. The carrier loaded with a plurality of containers of claim 1, wherein each female flap in the carrier which is formed from the secondary female opening has an arcuate tab formed by the slit forming the secondary female opening.

3. The carrier loaded with a plurality of containers of claim 1, which carrier has two ends which are open except for the top end restraining panels.

4. The carrier loaded with a plurality of containers of claim 3, in which the top end restraining panels are capable of being folded a closed position on a wrap machine by pressure; the holding flaps holding the top end panel in the closed position.

5. The carrier loaded with a plurality of containers of claim 1, in which the slight bulging outwardly of the side walls of the containers which are adjacent the side panels of the carrier is in the form of a slight curve between the top and bottom of the containers.

6. The carrier loaded with a plurality of containers of claim 1, in which the carrier has been tightened and locked so that the inner side walls of the containers in the two rows which are adjacent each other are restrained from bulging so that the inner side walls of the containers assist in holding the secondary male locks between the containers in the vertical locked position.

7. The carrier loaded with a plurality of containers of claim 1, in which at least one top dispenser flap is formed as a part of the top panel and adjoining side panels by tear lines which permit the opening of the top dispenser flap so the containers can be removed from the carrier.

8. The carrier loaded with a plurality of containers of claim 4, in which at least one top dispenser flap is formed as a part of the top panel and adjoining side panels by tear lines which permit the opening of the top dispenser flap so the containers can be removed from the carrier.

9. The carrier loaded with a plurality of containers of claim 1, in which a carrying handle is formed in the top panel between the adjoining side panels for carrying the loaded carrier.

10. The carrier loaded with a plurality of containers of claim 9, in which at least one top dispenser flap is formed as a part of the top panel and adjoining side panels by tear lines which permit the opening of the top dispenser flap so the containers can be removed from the carrier.

11. The carrier loaded with a plurality of containers of claim 10, in which two top dispenser flaps are formed as a part of the top panel and adjoining side panels by tear lines.

12. The carrier loaded with a plurality of containers of claim 4, wherein the female flap formed from the secondary female opening has an arcuate tab formed by the slit forming the secondary female opening.

13. The carrier loaded with a plurality of containers of claim 1, wherein there are four spaced apart secondary male locks and four spaced apart secondary female openings.

14. A wrap-around container carrier loaded with a plurality of containers, the containers having a rectangular or square cross-section and flexible side walls and being filled with liquid and being disposed in at least two rows, the carrier comprising:

(a) a top panel, two side panels and a bottom panel, the bottom panel formed from an inner bottom flap and an outer bottom panel foldably attached to an outer secondary locking flap, said outer secondary locking flap overlapping a portion of the inner bottom flap, at least one secondary male lock formed as an extension of the outer secondary locking flap, the inner bottom flap having a secondary female opening for each secondary male lock, said opening formed by a slit and interconnecting fold line which forms a female flap in the female opening, the top panel including top end restraining panels comprising top end flaps, tuck-in panels, triangular shaped web panels, triangular gusset panels, and holding flaps; the top end restraining panels restraining the containers in the carrier;

(b) the outer secondary locking flap and inner bottom flap being held together by a single locking system that keeps the at least one secondary male lock in a vertical locked position with respect to the inner bottom flap to prevent disengagement, the single locking system operates without a primary locking system, the vertical locked position being maintained by said female flap leaning against the secondary male lock which extends through the female opening, the secondary male locks in the corresponding secondary female openings having further assistance in being held in the locked vertical position by the slight bulging outwardly of the side walls of the containers which are adjacent the side panels of the carrier; and (c) each secondary male lock and corresponding secondary female opening in the carrier being located between the containers, the containers providing further assistance in holding a secondary male lock in the vertical position, the weight of liquid in the containers resulting in inner side walls of each said container being held tightly against each other in straight vertical positions, pulling the containers in each row towards each other.

15. The wrap-around container carrier of claim 14, wherein each female flap formed from the secondary female opening has an arcuate tab formed by the slit forming the secondary female opening.

16. The wrap-around container carrier of claim 14, in which the carrier has two ends which are open except for the top end restraining panels.

17. The wrap-around container carrier of claim 16, in which the top end restraining panels are capable of being folded into a closed position on a wrap machine by pressure; the holding flaps holding the top end panel in the closed position.

* * * * *